US006209135B1

(12) United States Patent
Irvin

(10) Patent No.: US 6,209,135 B1
(45) Date of Patent: Apr. 3, 2001

(54) EXERCISE VEST WITH FLEXIBLE WEIGHTS

(76) Inventor: Scott Irvin, 251 Cheswick Ct., Alameda, CA (US) 94502

( * ) Notice: Subject to any disclaimer, the term of this patent is extended or adjusted under 35 U.S.C. 154(b) by 0 days.

(21) Appl. No.: 09/505,021

(22) Filed: Feb. 16, 2000

(51) Int. Cl.[7] ..... A41D 1/04
(52) U.S. Cl. ..... 2/102; 2/94
(58) Field of Search ..... 2/102, 69, 94, 2/456, 247, 2.5; 482/105, 139

(56) References Cited

U.S. PATENT DOCUMENTS

| | | | | |
|---|---|---|---|---|
| 4,407,497 | * | 10/1983 | Gracie | 272/119 |
| 4,440,525 | * | 4/1984 | Perla | 405/186 |
| 4,602,387 | | 7/1986 | Zakrzewski . | |
| 4,658,442 | | 4/1987 | Tomlinson et al. . | |
| 4,929,211 | * | 5/1990 | Resnick et al. | 446/14 |
| 4,989,267 | | 2/1991 | Watson . | |
| 5,002,270 | | 3/1991 | Shine . | |
| 5,144,694 | * | 9/1992 | Conrad Da Oud et al. | 2/69 |
| 5,937,441 | * | 8/1999 | Raines | 2/69 |

* cited by examiner

*Primary Examiner*—John J. Calvert
*Assistant Examiner*—Tejash Patel
(74) *Attorney, Agent, or Firm*—Jack Lo

(57) ABSTRACT

The present weighted exercise vest is comprised of right and left front panels connected to a back panel by elastic sides and webbing straps on top. A plurality of weights are removably but snugly received in elastic pockets arranged on the front panels and the back panel. The weights are securely retained by elastic flaps over the pockets. Each panel is preferably constructed of spandex inner and outer sheets for a snug fit, rubber padding sheets between the spandex inner and outer sheets for cushioning impact, and a strong webbing sheet between the rubber padding sheets for attaching the pockets and straps. The webbing sheet generally spans the entire area of each panel for maximum durability. Each weight includes a core comprised of 90% lead shot embedded in 10% silicone rubber for providing the necessary mass, but also enough flexibility to bend with the user's body. The core is surrounded by a silicone gel shell for cushioning impacts and further improving comfort. The silicone shell is surrounded by a spandex shell for making insertion into the pockets easier.

12 Claims, 3 Drawing Sheets

EXERCISE VEST WITH FLEXIBLE WEIGHTS

BACKGROUND OF THE INVENTION

1. Field of the Invention

This invention relates generally to weighted exercise vests.

2. Prior Art

Weights are often used in strength, endurance, and muscle building exercises for increasing resistance and intensifying the workout. Free weights, such as hand weights, are useful for exercising every muscle in the body. However, they must be held by the person's or a partner's hands at all times. To enable a person to exercise solely, free the hands, and to carry the load more efficiently, weights have been attached to vests worn over the torso. Weighted vests are designed to increase muscle strength and mass during exercises that are typically known to only increase endurance.

A weighted vest disclosed in U.S. Pat. No. 4,989,267 to Watson is comprised of single-layer front and back panels, and weights adhered to recesses in the panels. The sides of the panels are connected by staps, which are uncomfortable because they do not stretch when the user's torso is bent and flexed. The panels are made of a closed cell copolymer material, which although disclosed as flexible, are thick enough to limit freedom of movement. The weights are made of a heavy metal, and coated with a plastic or rubber material. Each weight is made of a single piece of rigid metal that does not bend with the body, so that they are uncomfortable when the body is bent and flexed. The rigid weights may also cause pain when the wearer slams into another person, such as when playing a contact sport. Because they are merely adhered to the panel, the weights may be knocked off when making contact with another person.

Another weighted vest disclosed in U.S. Pat. No. 5,002,270 to Shine is comprised of front and back panels laced together on the sides. Bags of lead shots are inserted in pockets on the panels, and may be selectively removed for adjusting the load. Although the width of the vest is adjustable by loosening or tightening the lacing, adjusting long lacing is difficult and time consuming. Once adjusted, the lacing does not stretch when the user's torso is bent and flexed. If the lead shots are packed loosely in the bags, they will slosh around and cause discomfort and noise. If the lead shots are packets tightly in the bags, they will become very rigid and uncomfortable.

Another weighted vest disclosed in U.S. Pat. No. 4,658,442 to Tomlinson et al. is comprised of front and back panels joined by elastic sides that provide more comfort when the user's torso is bent and flexed. The width of the vest is adjustable by adjusting hook-and-loop straps on the front. Weights received in front and back pockets are comprised of solid lead plates surrounded by a padded coating. Although the weights are bendable by hand to conform to the body, they are not at all resilient, and are still rigid enough to cause discomfort when the user's torso is bent and flexed. The weights may also slide out of the open pockets during rigorous exercise.

Another weighted vest disclosed in U.S. Pat. No. 4,602,387 to Zakrzewski is comprised of front and back panels with pockets holding rigid metal bars. Straps stretched across the pocket openings hold the bars in place. However, the long rigid bars severely limit the wearer's freedom of movement, and may cause discomfort when the user's torso is bent and flexed.

A common disadvantage of most prior art weighted vests is that their fabric construction cannot properly support the heavy weights, so that they sag and tear with age. The fabric panels are non-stretchable, so that they cannot fit snugly enough to prevent shifting. Yet another common disadvantage is that the weights are carried too low on the torso for comfort and proper load distribution.

OBJECTS OF THE INVENTION

Accordingly, objects of the present exercise vest are:

- to increase resistance during exercising for more rapidly building muscles with reduced repetition;
- to be quickly adjustable in width and height to fit different wearers;
- to properly distribute the weights on the wearer;
- to have removable weights for adjusting the total load and weight distribution;
- to have pockets that are easily opened for removing the weights;
- to have pockets that securely retain the weights even during rigorous exercise;
- to be highly flexible for comfort;
- to have flexible and resilient weights for comfort;
- to fit snugly enough to prevent shifting during rigorous exercise;
- to be durable.

Further objects of the present invention will become apparent from a consideration of the drawings and ensuing description.

BRIEF SUMMARY OF THE INVENTION

The present weighted exercise vest is comprised of right and left front panels connected to a back panel by elastic sides and webbing straps on top. A plurality of weights are removably but snugly received in elastic pockets arranged on the front panels and the back panel. The weights are securely retained by elastic flaps over the pockets. Each panel is preferably constructed of spandex inner and outer sheets for a snug fit, rubber padding sheets between the spandex inner and outer sheets for cushioning impact, and a strong webbing sheet between the rubber padding sheets for attaching the pockets and straps. The webbing sheet generally spans the entire area of each panel for maximum durability. Each weight includes a core comprised of 90% lead shot embedded in 10% silicone rubber for providing the necessary mass, but also enough flexibility to bend with the user's body. The core is surrounded by a silicone gel shell for cushioning impacts and further improving comfort. The silicone gel shell is surrounded by a spandex shell for making insertion into the pockets easier.

DETAILED DESCRIPTION OF THE INVENTION

Figure 1:
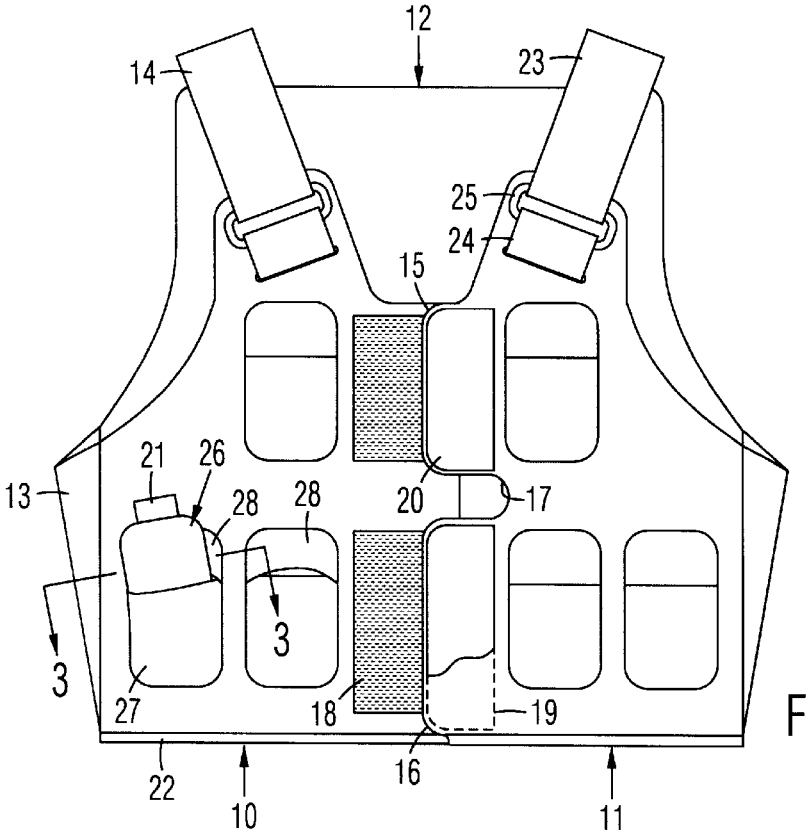
FIG. 1 is a front view of the present weighted exercise vest.

FIG. 1:

A preferred embodiment of the present exercise vest is shown in a front view in FIG. 1. It is comprised of a right front panel 10 and a left front panel 11 joined to a back panel 12 by elastic side panels 13 on the sides, and adjustable length webbing straps 14 on the top. Elastic sides 13 are preferably made of four-way-stretch spandex for snugly fitting a user. Front panels 10 and 11 are preferably shorter than back panel 12.

Upper and lower tabs 15 and 16 extend from the inner end of left front panel 11, and are separated from each other by a notch 17. Tabs 15 and 16 are removably attachable to an inner end of right front panel 10 by hook-and-loop fasteners 18 on the outer surface of right front panel 10 and hook-and-loop fasteners 19 on the inner surfaces of tabs 15 and 16. The width of the vest is adjustable for fitting different users by adjusting the position of tabs 15 and 16 on right front panel 10. Since upper and lower tabs 15 and 16 are separated by notch 17, they are somewhat independently adjustable relative to each other for independently tightening the upper and lower portions of left front panel 11 to right front panel 10. The outer surfaces of tabs 15 and 16 are reinforced by webbing 20. The lower edges of front panels 10 and 11, and back panel 12 are reinforced by webbing trim 22. Straps 14 are each comprised of an upper strap 23 connected to a lower strap 24 by a ring 25. The length of upper strap 23 is adjustable for fitting different users of different height by pulling it through ring 25.

A plurality of weights 26 are received in pockets 27 attached to front panels 10 and 11 for increasing resistance during exercising, thereby promoting muscle building, increasing strength, and increasing endurance. Weights 26 are preferably in the arrangement shown for proper weight distribution. Alternatively, more or fewer pockets may be provided, and in different arrangements. A webbing pull tab 21 is attached to each weight 26 for making removing weight 26 from pocket 27 easier. Weight 26 is easily installed by pulling out pocket 27 from under an overlapping flap 28, inserting weight 26 in pocket 27, and lowering flap 28 over weight 26, as shown at the lower left pockets in FIG. 1. Pocket 27 and flap 28 are preferably made of an elastic material, such as four-way-stretch spandex, for snugly holding weights 26 to prevent them from shifting or falling out during vigorous exercises. Weights 26 may be removed from some pockets 27 for adjusting the total weight or the weight distribution according to individual requirements.

Figure 2:
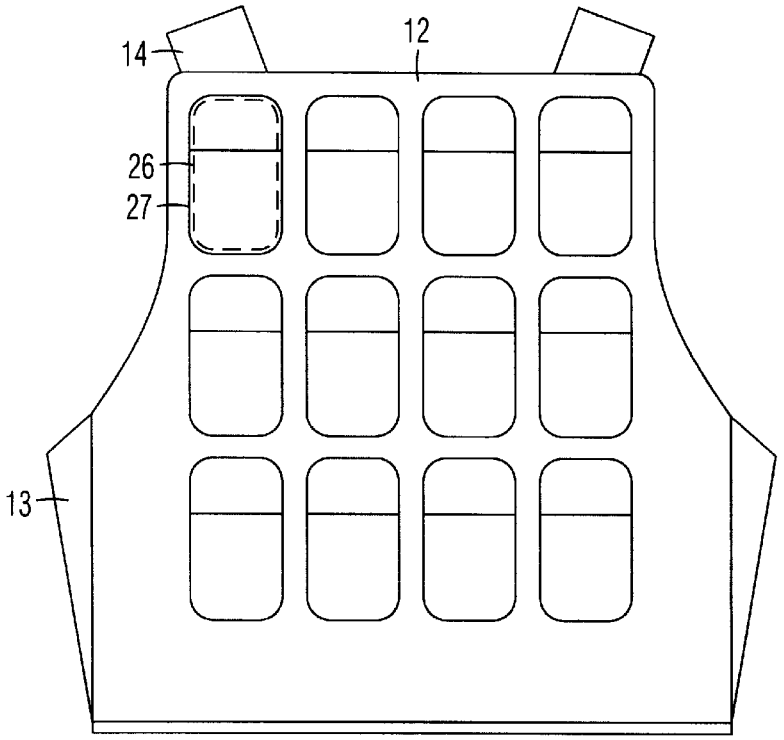
FIG. 2 is a rear view thereof.

FIG. 2:

A rear view of the exercise vest is shown in FIG. 2. A plurality of weights 26 are received in pockets 27 attached to back panel 12, preferably in the arrangement shown, and particularly close to the upper end of back panel 12 for proper weight distribution. Alternatively, more or fewer pockets may be provided, and in different arrangements.

Figure 3:
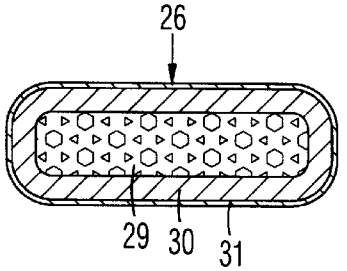
FIG. 3 is a sectional view of a weight thereof, taken along line 3—3 in FIG. 1.

FIG. 3:

As shown in a sectional view in FIG. 3, weight 26 is comprised of a core 29 surrounded by a first shell 30 and a second shell 31. Core 29 is preferably comprised of 90% lead shot embedded in 10% silicone rubber, so that it has the necessary mass, but also enough flexibility for bending with the user's body. Alternatively, the ratio between lead shot and silicone may be changed for adjusting the balance between mass and flexibility. First shell 30 is preferably comprised of silicone gel to provide resilience for comfort when pressed against the user's body. Second shell 31 is preferably made of spandex to protect first shell 30, and to provide a relatively low friction surface to enable weight 26 to be easily slipped into a pocket. Without spandex second shell 31, the sticky texture of silicone gel first shell 30 would make inserting the weight difficult.

Figure 4:
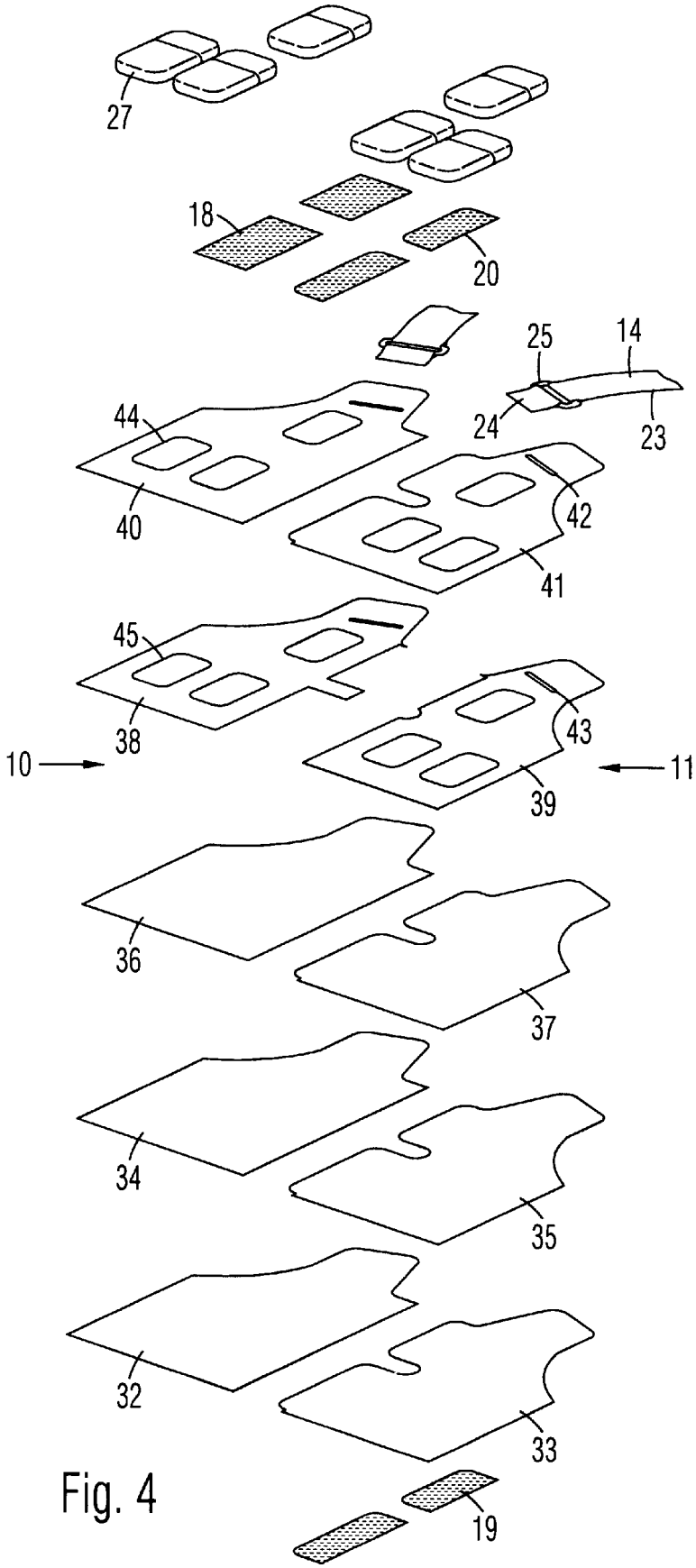
FIG. 4 is an exploded view of a pair of front panels thereof.

FIG. 4:

Right front panel 10 and left front panel 11 are shown in an exploded view in FIG. 4. They are respectively and preferably comprised of components connected in the following order: inner four-way-stretch spandex sheets 32 and 33, inner rubber padding sheets 34 and 35, webbing sheets 36 and 37, outer rubber padding sheets 38 and 39, and outer four-way-stretch spandex sheets 40 and 41. Hook-and-loop fasteners 19 are attached to the inner surface of inner spandex sheet 33. Hook-and-loop fasteners 18 are attached to the outer surface of outer spandex sheet 40. Webbing 20 are attached to the outer surface of outer spandex sheet 41. Lower strap 24 of each strap 14 is pulled through slots 42 on outer spandex sheets 40 and 41, through slots 43 on outer rubber padding sheets 38 and 39, and attached to webbing sheets 36 and 37. The inner sides of pockets 27 are positioned through holes 44 on outer spandex sheets 40 and 41, through holes 45 on outer rubber padding sheets 38 and 39, and attached to webbing sheets 36 and 37. Webbing sheets 36 and 37 provide a strong anchor for straps 14 and pockets 27, and generally span the entire area of front panels 10 and 11 for maximum durability.

Figure 5:
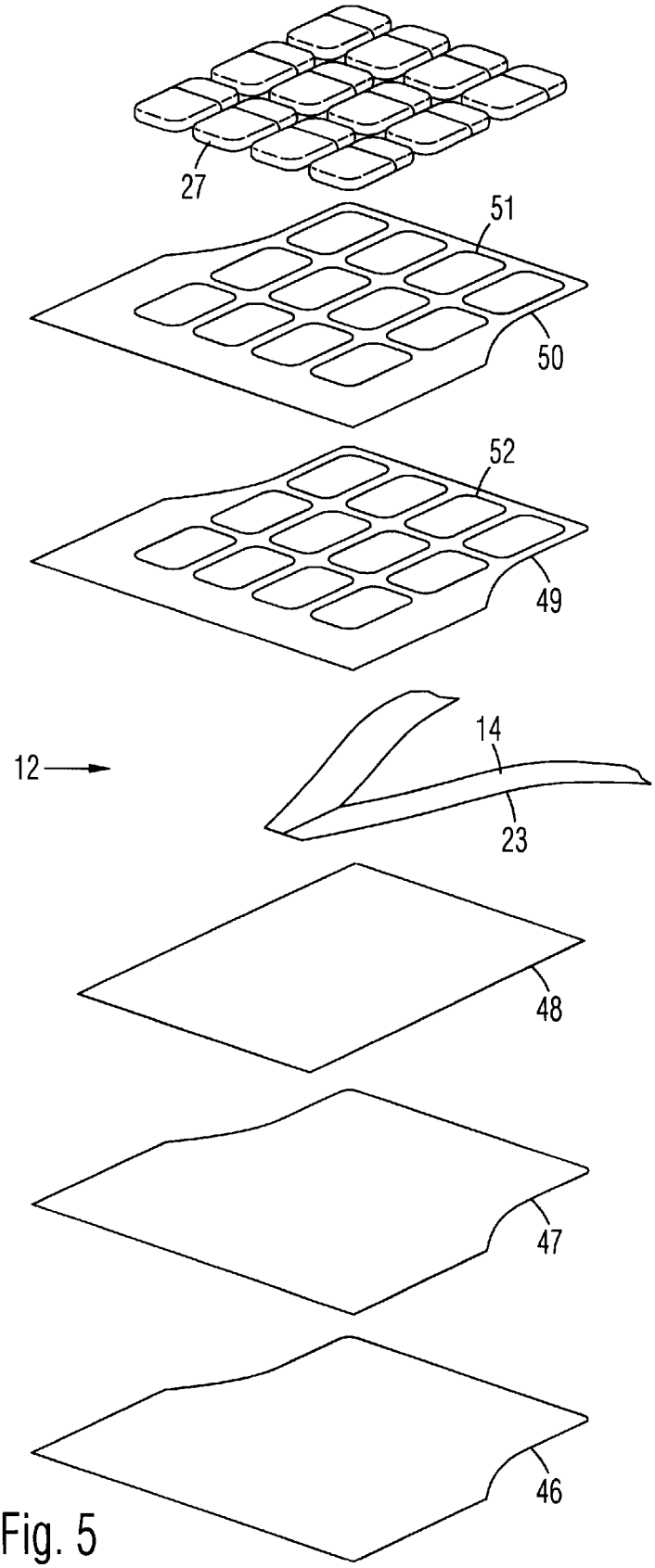
FIG. 5 is an exploded view of a back panel thereof.

FIG. 5:

Back panel 12 is shown in an exploded view in FIG. 5. It is preferably comprised of components connected in the following order: inner four-way-stretch spandex sheet 46, inner rubber padding sheet 47, webbing sheet 48, outer rubber padding sheet 49, and outer four-way-stretch spandex sheet 50. The back ends of upper straps 23 are preferably joined together in a "V" shape, and attached to webbing sheet 48. The inner sides of pockets 27 are positioned through holes 51 on outer spandex sheet 50, through holes 52 on outer rubber padding sheet 49, and attached to webbing sheet 48. Webbing sheet 48 provides a strong anchor for straps 14 and pockets 27, and generally span the entire area of back panel 12 for maximum durability.

SUMMARY AND SCOPE

Accordingly, the present weighted exercise vest increases resistance with weights during exercising for more rapidly building muscles with reduced repetition. It is quickly adjustable in width to fit different wearers. It has removable weights for adjusting the total load and weight distribution. It properly distributes the weights on the wearer. It has pockets that are easily opened for removing the weights. It has pockets that securely retain the weights even during rigorous exercise. It is highly flexible for comfort. It fits snugly enough to prevent shifting during rigorous exercise. It is durable.

Although the above description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

I claim:

1. A weighted exercise vest, comprising:

a plurality of panels connected together; and a plurality of weights attached to said panels, each of said weights including a core comprised of lead shots embedded and fixed in position relative to each other in silicone rubber which bends with the user's body.

2. The weighted exercise vest of claim 1, wherein said core is comprised of about 90% lead shots and about 10% silicone rubber.

3. The weighted exercise vest of claim 1, further including a silicone gel shell surrounding said core for cushioning impacts and improving comfort.

4. The weighted exercise vest of claim 1, further including a silicone gel shell surrounding said core for cushioning impacts and improving comfort, and a spandex shell surrounding said silicone shell for low friction.

5. A weighted exercise vest, comprising:

a plurality of panels, including a right front panel, a left front panel, and a back panel connected together, each of said panels including an elastic outer sheet and an elastic inner sheet for a snug fit, and a webbing sheet positioned between and coextensive with said elastic outer sheet and said elastic inner sheet for durability;

a plurality of elastic pockets attached to said panels, each of said pockets including an elastic flap, said pockets being attached to said webbing sheet in said panels for durability;

a plurality of weights removably and snugly received in said elastic pockets, said weights being securely retained by said elastic flap in each of said pockets; and a plurality of holes on said elastic outer sheet, said pockets positioned through said holes and attached to said webbing sheet for durability.

6. A weighted exercise vest, comprising:

a plurality of panels, including a right front panel, a left front panel, and a back panel connected together, each of said panels including an elastic outer sheet and an elastic inner sheet for a snug fit, and a webbing sheet positioned between and coextensive with said elastic outer sheet and said elastic inner sheet for durability;

a plurality of elastic pockets attached to said panels, each of said pockets including an elastic flap, said pockets being attached to said webbing sheet in said panels for durability;

a plurality of weights removably and snugly received in said elastic pockets, said weights being securely retained by said elastic flap in each of said pockets;

a slot on said elastic outer sheet of said right front panel and said left front panel; and a pair of webbing straps respectively connected between said right front panel and said back panel, and between said left front panel and said back panel, each of said webbing straps positioned through said slot and attached to said webbing sheet for durability.

7. A weighted exercise vest, comprising:

a plurality of panels, including a right front panel, a left front panel, and a back panel connected together, each of said panels including an elastic outer sheet and an elastic inner sheet for a snug fit, and a webbing sheet positioned between and coextensive with said elastic outer sheet and said elastic inner sheet for durability;

a plurality of elastic pockets attached to said panels, each of said pockets including an elastic flap, said pockets being attached to said webbing sheet in said panels for durability;

a plurality of weights removably and snugly received in said elastic pockets, said weights being securely retained by said elastic flap in each of said pockets; and a webbing pull tab attached to each of said weights for making removal easier.

8. A weighted exercise vest, comprising:

a plurality of panels, including a right front panel, a left front panel, and a back panel connected together by elastic sides on opposite sides and a pair of webbing straps on top, each of said panels including an elastic outer sheet and an elastic inner sheet for a snug fit, a pair of rubber padding sheets between said elastic inner sheet and said elastic outer sheet for cushioning impact, and a webbing sheet positioned between and coextensive with said elastic outer sheet and said elastic inner sheet for durability;

a plurality of elastic pockets attached to said panels, each of said pockets including an elastic flap, said pockets being attached to said webbing sheet in said panels for durability; and a plurality of weights removably and snugly received in said elastic pockets, said weights being securely retained by said elastic flap in each of said pockets, each of said weights including a core comprised of lead shots embedded in silicone rubber for providing mass for resistance, and also flexibility for bending with a user's body, said core being surrounded by a silicone gel shell for cushioning impacts and improving comfort, said silicone gel shell being surrounded by a spandex shell which makes insertion into said pockets easier.

9. The weighted exercise vest of claim 8, further including a plurality of first holes on said elastic outer sheet and a plurality of second holes on an outer one of said rubber padding sheets, said pockets positioned through said first holes and said second holes, and attached to said webbing sheet for durability.

10. The weighted exercise vest of claim 8, further including a first slot on said elastic outer sheet and a second slot an outer one of said rubber padding sheets of said right front panel and said left front panel, said webbing straps being positioned through said first slot and said second slot, and attached to said webbing sheet for durability.

11. The weighted exercise vest of claim 8, further including an upper tab and a lower tab extending from an inner edge of said left front panel and separated from each other by a notch, and hook-and-loop fasteners on inner surfaces of said upper tab and said lower tab, and on an outer surface of said right front panel, said upper tab and said lower tab being removably attachable to said right front panel and adjustable for tightness relatively independently of each other.

12. The weighted exercise vest of claim 8, further including a webbing pull tab attached to each of said weights for making removal easier.

* * * * *